US005578128A

United States Patent [19]

Schneider

[11] Patent Number: 5,578,128

[45] Date of Patent: Nov. 26, 1996

[54] APPARATUS FOR APPLYING HOT MELT GLUE TO ROUND AND NON-ROUND CONTAINERS

[75] Inventor: Wayne F. Schneider, Kansas City, Mo.

[73] Assignee: Sealright, Co., Inc., Desoto, Kans.

[21] Appl. No.: 385,557

[22] Filed: Feb. 8, 1995

[51] Int. Cl.[6] ..... B05C 5/00

[52] U.S. Cl. ..... 118/696; 118/712; 118/306; 118/317; 118/323; 118/DIG. 3; 156/356; 156/578

[58] Field of Search ..... 118/710, 684, 118/306, 317, 323, DIG. 2, DIG. 3, 696–698, 712; 156/294, 356, 578; 239/750, DIG. 13, 227, 281, 209

[56] References Cited

U.S. PATENT DOCUMENTS

| | | | |
|---|---|---|---|
| 2,046,592 | 7/1936 | Tracy | 239/DIG. 13 |
| 2,895,449 | 7/1959 | Oldfield, Jr. | 118/317 |
| 4,259,372 | 3/1981 | Eddy | 156/578 |
| 4,564,410 | 1/1986 | Ceitheros et al. | 156/357 |
| 4,774,905 | 10/1988 | Nobis | 427/236 |
| 4,976,797 | 12/1990 | Calvert et al. | 156/578 |

*Primary Examiner*—Laura Edwards

[57] ABSTRACT

An apparatus is provided according to the present invention for applying a glue bead to a round and non-round container to seal a fitment therein. The container includes a side wall formed about a longitudinal axis and having a closed end and an open end. The apparatus includes a base for holding the container in a fitment applying position and a hot melt glue gun for applying a layer of glue about an interior perimeter of the container to form an adhesion region. The adhesion region extends about the interior of the side walls immediately adjacent the open end thereof. The glue gun is suspended from a rotary bearing assembly which drives the gun about a longitudinal axis of the container as glue is sprayed thereon. A drive pulley, connected to the gun, is remotely driven via a belt and shaft arrangement by an electric motor. The electric motor is controlled to vary the rotational velocity of the gun dependent upon its angular position relative to a starting point to adjust for changes in the radial distance between the gun and the container. The velocity is adjusted such that the spray gun rotates faster when directed towards a portion of the side wall which is close to the spray nozzle and slower when the nozzle is directed toward a portion of the side wall which is remotely located therefrom. By adjusting the rotational velocity of the glue gun, an even bead of glue is applied.

16 Claims, 5 Drawing Sheets

APPARATUS FOR APPLYING HOT MELT GLUE TO ROUND AND NON-ROUND CONTAINERS

FIELD OF THE INVENTION

The present invention generally relates to a device for applying hot melted glue to an inner rim of a container to seal a fitment or end cap to the container.

BACKGROUND OF THE INVENTION

As is well known in the packaging field, generally a product is manufactured by forming a container wall in a desired shape (such as round, oval, rectangular and the like), attaching a base to the container and filling the container with the goods to be packaged. Once filled, the fitment and lid are secured to the open end of the container. The container fitment generally included an outer side wall having an upper U-shaped rim about its edge and directed downward. The fitment is inserted into the container until the U-shaped rim securely fits over the upper edge of the container wall. Prior to inserting the fitment, past systems injected a bead of hot melt glue about the fitment along its outer periphery. In round containers, as the fitment was inserted, the upper portion of the inner wall of the container contacted the bead of hot melt glue and smeared the glue along the outer surface of the fitment and the inner surface of the container until the U-shaped rim engaged the top of the container.

The foregoing process worked satisfactorily for round containers and round fitments.

However, the above conventional process was unsatisfactory for non-round containers. Non-round containers generally include opposed long side walls which are quite flat, or include minimal curvature. These flat side walls are more difficult to maintain in a desired curvature or plane while inserting the fitment. Instead, the curvature of the side walls fluctuates slightly, differing from the curvature of the fitment. Hence, when the container fitment is inserted, the upper edge of the side wall portions contact the fitment below the glue bead. Such contact causes the upper edge of the container effectively to wipe the bead of hot melt glue off of the fitment as the fitment passes the container side wall. Consequently, the majority of the hot melt glue is forced out of the container and outside of the fitment, thereby producing an interconnection having less than 100% adhesion and thus less than 100% "fiber tear" between the container and fitment. This wiping operation further wastes glue and presents an overall dirty appearance upon the outside of the container.

An alternative system has been proposed in the past for round containers, in which a bead of hot melt glue is injected from a glue gun positioned remote from the container and located along one side thereof. The glue gun sprays a stream of glue downward into and across the open end of the container onto the opposite side wall as the container is rotated, thereby covering the interior perimeter of the container. However, this system has only proven effective with round containers since, as the non-round container was rotated while the glue gun remained stationary, the distance varied between the gun and container. Additionally, the relative velocity of the container side wall varied. Thus, systems utilizing a stationary gun with a non-round container experienced variations in the radial speed at which the glue was applied thereby changing the thickness of the bead. The system was unable to compensate and these variations in distance and relative velocity rendered it impossible to apply an even bead of glue to the container from a stationary gun.

A need remains in the industry for an apparatus capable of evenly applying hot melt glue to non-round containers. It is an object of the present invention to overcome the disadvantages heretofore experienced and meet this need.

SUMMARY OF THE INVENTION

An apparatus is provided according to the present invention for applying a non-round fitment to a non-round container. The container includes a side wall formed about a longitudinal axis and having a closed bottom end and an open top end. The apparatus includes a base for holding the container in a fitment applying position and a hot melt glue gun for applying a bead of glue about an interior perimeter of the container within a fitment adhesion region. The adhesion region extends about the interior of the side walls immediately adjacent the open end thereof. The glue gun is suspended from a rotary bearing assembly which drives the gun about a longitudinal axis of the container as glue is sprayed thereon. A drive mount, connected to the gun, is remotely driven via a belt and pulley arrangement by an electric motor. The electric motor is controlled to vary the rotational velocity of the gun dependent upon its angular position relative to a starting point to adjust for changes in the distance between the gun and the container. The velocity is adjusted such that the spray gun rotates faster when directed towards a portion of the side wall which is close to the gun's spray nozzle and slower when the nozzle is directed toward a portion of the side wall which is remotely located therefrom. By adjusting the rotational velocity of the glue gun, an even bead of glue is applied to the container.

DETAILED DESCRIPTION OF THE DRAWINGS

The objects and features of the invention noted above are explained in more detail with reference to the drawings, in which like reference numerals denote like elements, and in which.

DETAILED DESCRIPTION OF THE INVENTION

Figure 1:
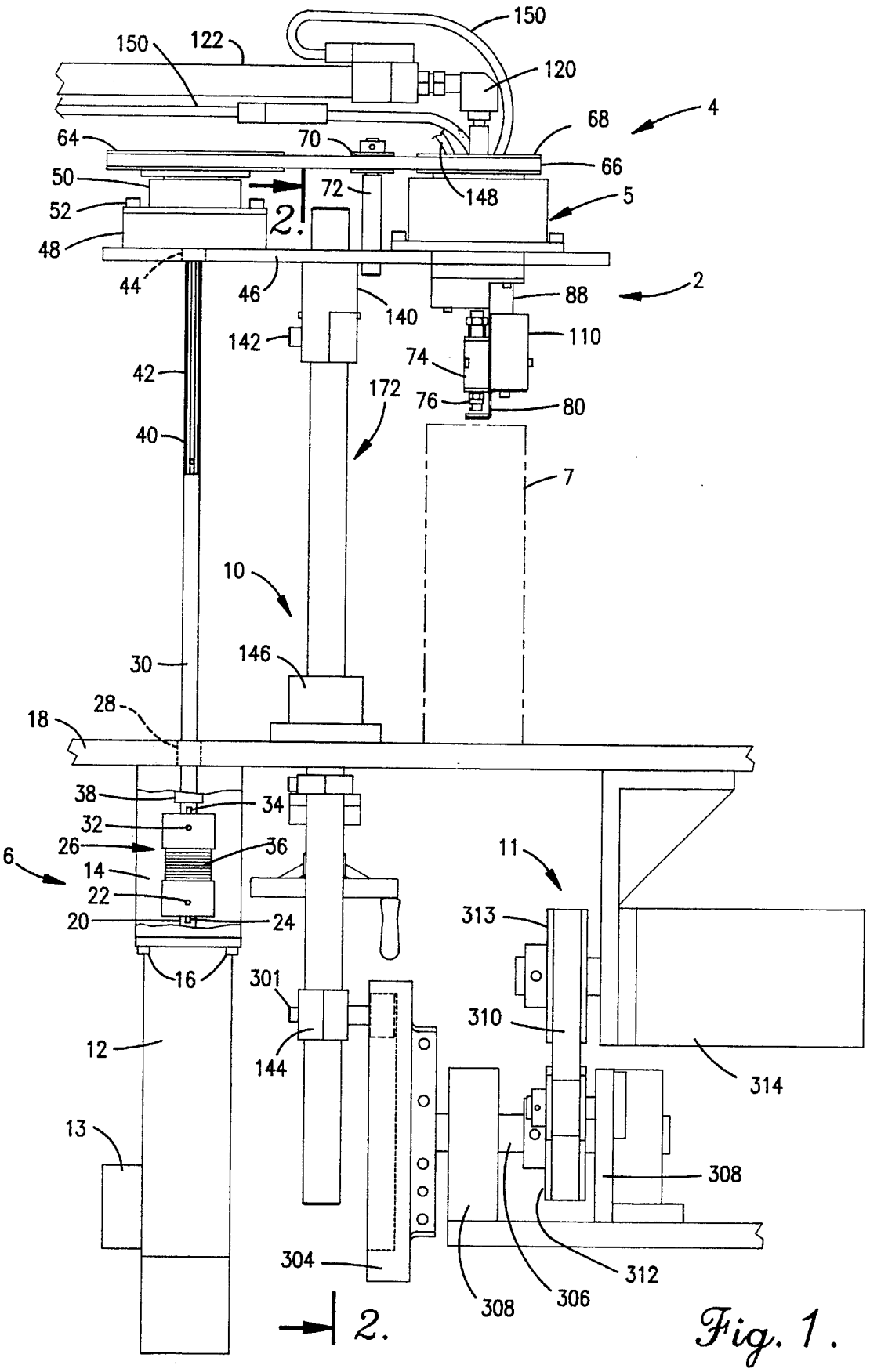
FIG. 1 illustrates a side elevational view of an apparatus according to the present invention.

FIG. 1 generally illustrates an apparatus according to the present invention. The inventive apparatus generally includes a rotating glue gun assembly 2 driven by a pulley assembly 4 which is powered by a drive assembly 6. The gun and pulley assemblies 2 and 4 are secured upon a moving gun platform 46 which is supported and vertically movable by a vertical support assembly 10. The support assembly 10 is vertically moved along its axis by a drive means 11 in order to move the gun assembly 2 between a glue applying position proximate an open end of a container 7 and a transition position. The longitudinal axis of the support assembly 10 is aligned along the direction of linear movement of the gun assembly 2 when moved between the glue applying and transition positions. This movement effects insertion and removal of the gun from the open end of the container.

The drive assembly 6 includes a motor 12 aligned such that the longitudinal axis of its drive shaft 20 extends in a direction parallel to the longitudinal axis of the vertical support assembly 10. The motor 12 is aligned with its front face securely affixed to a motor mounting plate 14 via bolts 16. An opposite end of the mounting plate 14 is securely bolted to one end of a base mounting plate 18. The drive shaft 20 of the motor 12 is secured via a set screw 22 and key 24 to one end of a coupling 26.

Control means 13 is operably connected to the motor 12 as a separate or integral part of the motor, is utilized to control the rotational velocity of motor and consequently the glue gun.

The vertical support assembly 10 includes a stationary base mounting plate 18 aligned in a horizontal plane. The plate 18 includes a hole 28 therethrough which receives a drive extension shaft 30 aligned along the longitudinal axis of the drive shaft 20. A lowermost end of the extension shaft 30 projects through the base mounting plate 18 and is securely mounted to an opposite end of the coupling 26 via a set screw and key 32 and 34, respectively. The coupling 26 includes an intermediate section 36 securing opposite ends together. The lower end of the extension shaft 30 is supported horizontally by a bearing assembly 38 securely mounted to the lower side of the base mounting plate 18. The extension shaft 30 is supported vertically by the coupling 26 and the plate 14. The upper end of the extension shaft 30 is secured via a spring pin 40 to the lower end of a splined shaft 42 also extending along the axis of the drive shaft 20.

Figure 4:
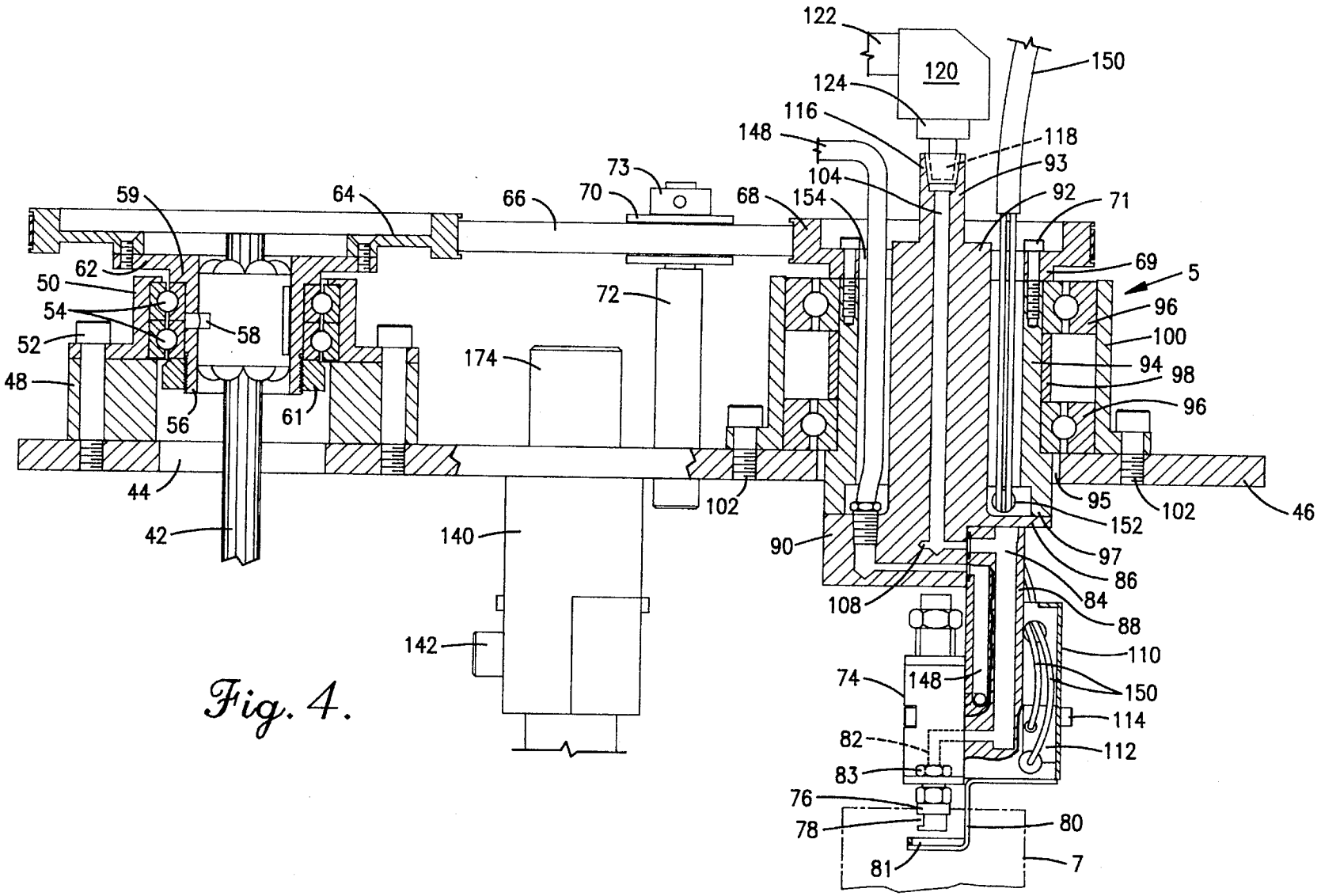
FIG. 4 illustrates a side sectional view of a glue gun according to the apparatus of FIG. 1.

As shown in FIG. 4, the upper end of the splined shaft 42 extends through a hole 44 in a vertically moving gun platform 46 which is aligned parallel to the mounting plate 18 and moves relative thereto. The splined shaft 42 and extension shaft 30 are constructed along a longitudinal axis parallel to the direction of movement of the platform 46 and gun assembly 2. The gun mounting platform 46 supportably receives a spline shaft support spacer 48 about the spline shaft receiving hole 44. A spline shaft bearing housing 50 is securely mounted upon the spacer 48 via bolts 52. The bearing housing 50 forms a hollow chamber which receives a bearing 54 (FIG. 4) that is secured to an inner race 56 via a key 58. The inner race 56 includes an upper flange 59 which is rotatably supported by the bearing 54. The bearings 54 are retained between the flange 59 and a threaded keeper 61.

A ball spline bearing mounting tube 62 is formed integral with or secured to the upper flange 59 on the inner race 56. The mounting tube 62 receives a timing pulley 64 secured to its upper side. The timing pulley 64 is aligned to rotate about the rotational axis of the drive assembly 6 which corresponds to that of the spline shaft 42. The timing pulley 64 is secured to the mounting tube 62 and hence the inner race 56, thereby transferring a driving force from the spline shaft 42 to the timing pulley 64 during operation. The inner race 56 allows linear movement, along its longitudinal or rotational axis, between the spline shaft 42 and the timing pulley 64 while maintaining a secure rotary driving relation therebetween to power rotary movement of the timing pulley 64. The linear movement is necessary when adjusting the operating height of the gun assembly 2 for containers of different heights and when loading and unloading containers as explained below in more detail.

Figure 3:
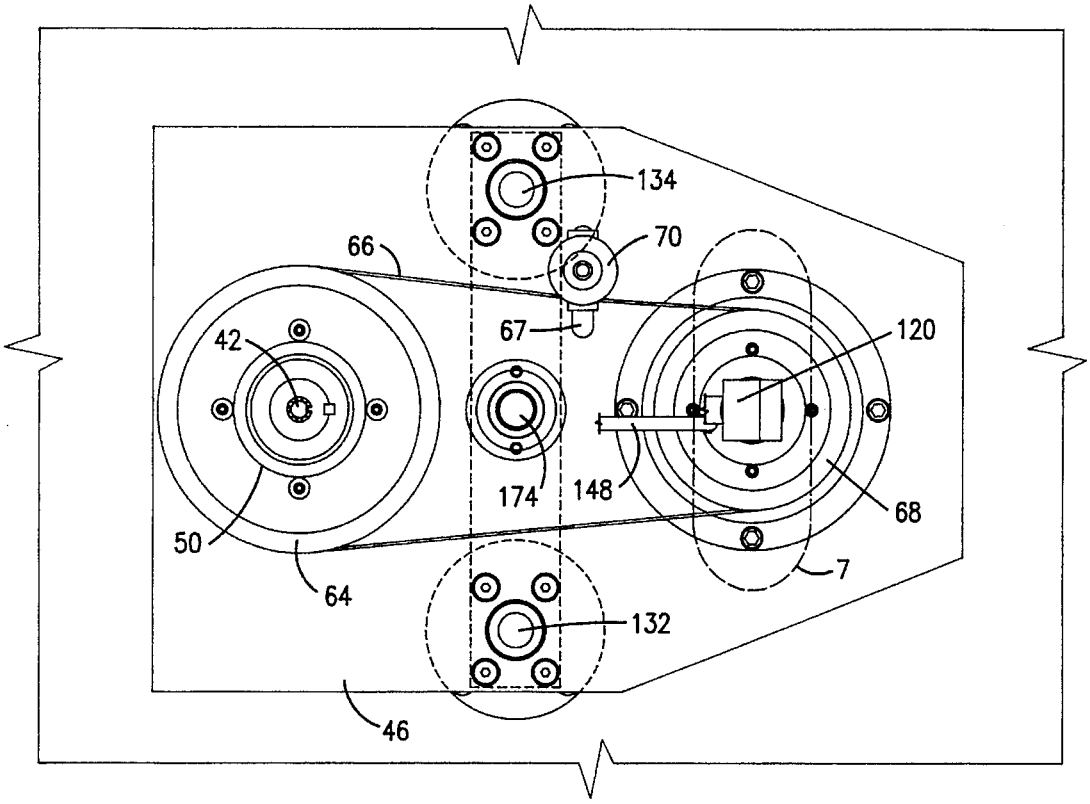
FIG. 3 illustrates a top plan view of an apparatus according to the present invention while applying glue to a container.

The timing pulley 64 receives a belt 66 which is also connected to a driven pulley 68 that drives the gun assembly 2. An idler pulley 70 is provided intermediate the timing and driven pulleys 64 and 68 in order to remove slack from the belt 66. The idler pulley 70 is rotatably mounted upon a mounting block 72 via a keeper 73 which is bolted within a track in the gun mounting platform 46. The track 67 (FIG. 3) is aligned at a right angle to the direction of movement of the belt 66. The block 72 is slidably adjusted within the track to tighten the idler pulley 70 against the belt 64.

The driven pulley 68 includes a lower rim 69 which is securely mounted, via screws 71, to an inner race 94 of a bearing assembly 5. The inner race 94 is supportably rotated about its periphery by bearings 96 separated by a spacer 98. Outer edges of the bearings 96 are seated within a bearing housing 100 securely bolted to the top of the mounting platform 46 via bolts 102. The pulley 68 and inner race 94 are aligned to turn about a rotational axis of the glue application path of the gun assembly 2. The bearing assembly 5 is positioned above a hole 95 through the mounting platform 46. The lower end of the inner race 94 includes a flared ridge projecting radially outward immediately below the lower bearing 96 and extending beyond a lower surface of the mounting platform 46 to form a support bracket 97. The support bracket 97 securely receives a gun module mounting plate 86 on its lower surface which supports a gun base block 90. The base block 90 securely supports a support frame 88 on one side thereof which projects downward and is securely affixed to an injection gun 74.

The inner race 94 includes a rotating mount 92 extending along the rotational axis. The rotating mount 92 includes an upper extension 93 which projects vertically above the inner race 94 and driven pulley 68. The rotating mount 92 includes a channel 104 extending along its longitudinal axis. The channel 104 includes a funnel shaped recess 116 at its upper end proximate the upper extension 93. The lower end of the channel 104 extends through the mounting plate 86 and the base block 90. A discharge channel 108 communicates with a glue pipe 84 formed within the support frame 88. An exit end of the glue pipe 84 communicates with a glue passage 82 within the injection gun 74.

A nozzle 76 is secured to the lower end of the glue gun 74 proximate the discharge end of the glue passage 82. The nozzle 76 includes an opening 78 directed in a direction perpendicular to the rotational axis of the injection gun 74. The opening 78 within the nozzle 76 directs the glue outward at an angle to the rotational axis when such glue is delivered thereto from the glue passage 82, glue pipe 84, and channels 104–108. In the preferred embodiment, the opening 78 directs the glue outward at a right or 90° angle to the rotational axis. However, this angle may be increased or decreased depending upon the proximity between the nozzle 76 and adhesion region of the container 7. For instance, if the nozzle is positioned above the container during a glue application, the opening 78 would be directed downward at an obtuse angle to the upper portion of the rotational axis.

The glue passage 82 includes a pneumatic valve 83 proximate its discharge end to open and close the glue path in order to control the discharge of glue. An L-shaped trough 80 is mounted upon and extends downward from the lower end of the glue gun 74. A horizontal portion 81 of the trough 80 is directed outward to cover the lower end of the nozzle 76. The trough 80 includes a ridge about its perimeter to form a holding area to collect excess glue which drips from the nozzle 74 after the valve 83 is closed.

The funnel shaped recess 116 receives a glue injection tip 118 which is connected to a 90° swivel 120 and a hot melt delivery pipe 122 via a coupling 124. The tip 118 is securely received within the recess 116 and rotatably received within the swivel 120 in order to allow the rotating mount 92 and tip 118 to rotate with the injection gun 74 while the delivery pipe 122 remains stationary. The tip 118 maintains a sealed relation within the recess 116 in order to maintain pressure upon the glue within the pipe 122, the channel 104 and the passage 82. The glue is maintained at a pressure of approximately 1500 psi.

The support frame 88 is constructed of a highly thermo conductive material such that the temperature of the support frame 88 closely follows that of the glue within the glue pipe 84. A sensor 112 and a heater 114 are provided proximate the support frame 88 and the glue pipe 84 to control the temperature of the glue traveling therethrough. The sensor 112 monitors the temperature of the glue within the glue pipe 84 and controls the heater 114 accordingly to maintain the glue at a desired temperature, such as approximately 350° F. A protective shield 110 is provided about the sensor 112 and heater 114.

An air line 148 and an electrical line 150 are delivered with pipe 122 to the rotating mount 92. The air and electrical lines are secured to, and pass through, air and electrical passages 152 and 154 within the gun rotating mount 92, respectively. The air and electrical lines 148 and 150 similarly pass through the base block 90 and the support frame 88 to deliver pressurized air and electrical current to the injection gun 74. The pressurized air is delivered to the valve 83 to turn the glue ON and OFF. The pneumatic valve 83 provides a strong reliable means for controlling glue flow. Thus, the glue may be delivered under high pressure from the delivery pipe 122 to the injection gun 74 and pneumatically controlled. The electrical line is delivered through the gun rotating mount 92 to the heater 114 and sensor 112. The air and electrical lines 148 and 150 are flexible and provided with sufficient slack at the upper end of the rotating mount 92, in such a manner that they wrap thereabout as the gun rotates without interfering with operation. As explained below, at the end of each glue applying rotation, the gun assembly 2 retraces its rotary path in the reverse direction until it reaches the starting point. By retracing its path, the gun assembly 2 unwinds the air and electrical lines 148 and 150 at the close of each glue applying step. Optionally, the air and electrical lines 148 and 150 may be connected to the rotating mount 92 in a manner similar to that of the glue delivery pipe 122 in order to eliminate the need to unwind the gun assembly or retrace the glue path after each operation. Instead, with air and electrical swivel connections similar to swivel 120, the gun assembly 2 may simply be rotated, at the close of a glue applying operation, in the same direction to the starting point of a next glue applying operation.

Figure 2:
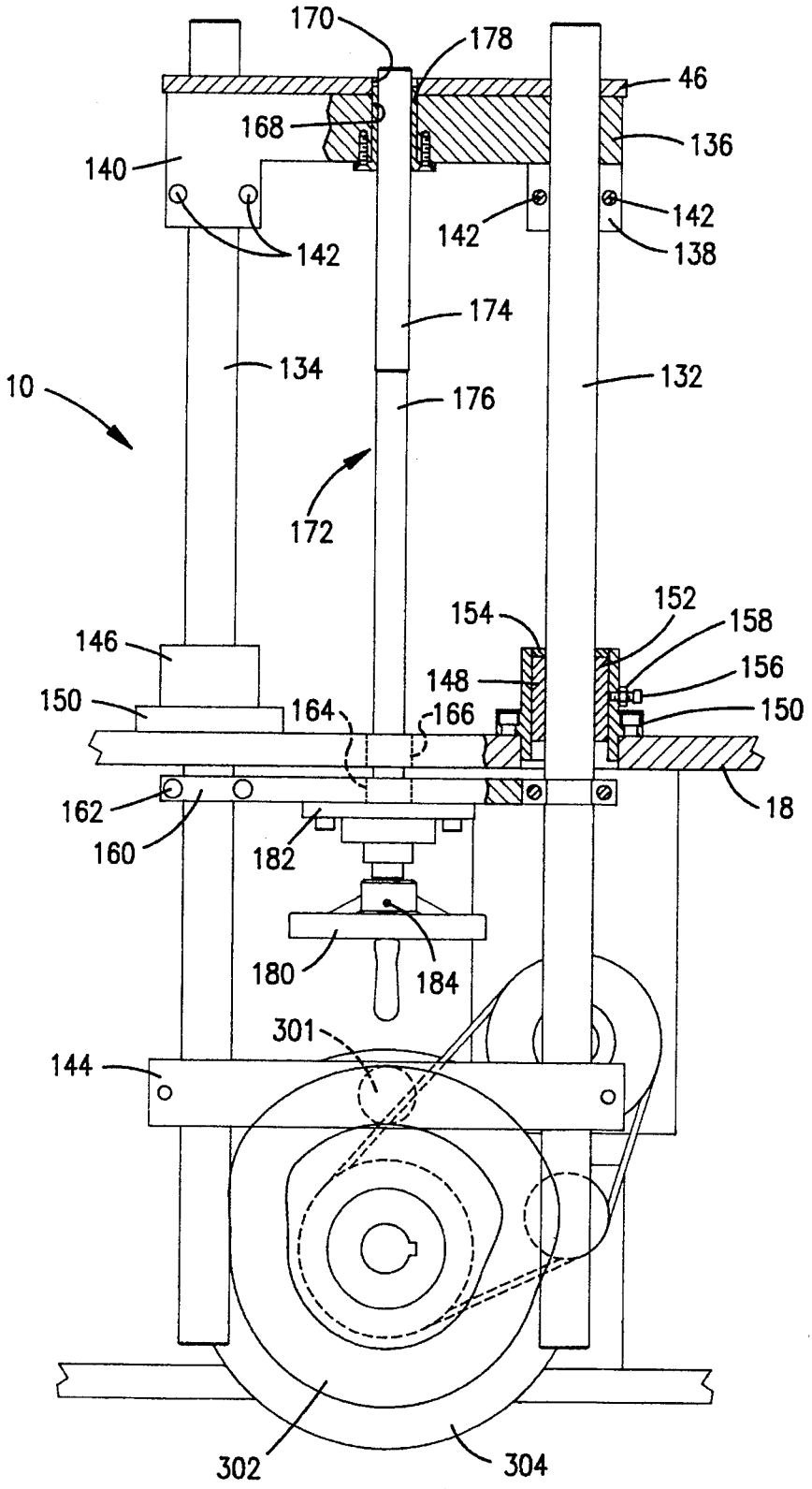
FIG. 2 illustrates a front view of the lifting assembly of the apparatus according to the present invention taken along line 2—2 in FIG. 1.

As best illustrated in FIG. 2, the vertical support assembly 10 which supports the gun mounting plate 46 includes twin drive shafts 132 and 134. The drive shafts 132 and 134 are located upon opposite sides of the belt 66 (FIG. 3) and centered along a tangent axis extending perpendicular to the belt axis (which extends between the drive and driven pulleys). The twin support shafts 132 and 134 are located at a balanced position between the drive and driven pulleys 64 and 68, respectively. A C-shaped bracket 136 is mounted upon the bottom side of the gun mounting plate 46 and traverses same along the center of gravity between the drive and driven pulleys 64 and 68. The C-shaped bracket 136 includes collars 138 and 140 located at opposite ends thereof and having journaled recesses therethrough. The journaled recesses align with corresponding holes through the mounting plate 46 to receive upper ends of the support shafts 132 and 134.

The collars are configured to be radially expandable and contractible to securely engage the upper ends of the support shafts 132 and 134. This radial adjustability may be achieved in several ways, such as providing each collar with separate half moon sections adjoining one another on opposite sides of the support shaft. The collars include bolts 142 extending therethrough which facilitate tightening of the collars 138 and 140 against the support shafts 132 and 134, respectively. The C-shaped bracket 136 is securely mounted upon the bottom surface of the mounting plate 46 via screws. As explained below in more detail, the bolts 142 may be loosened to allow the glue gun assembly to be adjusted in height.

As best shown in FIG. 1, the support shafts 132 and 134 include opposite or lower ends which are securely received within a base collar 144 which is securely affixed upon a pin 301 which travels within a track 302 on a wheel 304. The wheel 304 rotates upon a shaft 306 which spins within bearing supports 308. The shaft 306 is driven via a belt 310 and pulleys 312 and 313 connected to a motor 314 to drive means such as a cam assembly and the like (not shown).

The support shafts 132 and 134 are received, at intermediate points therealong, within linear bearing mounts 146 and 148 (FIG. 2). The bearing mounts 146 and 148 linearly support the shafts 132 and 134, while affording linear movement therebetween. The bearing mounts 146 and 148 include flanges 150 about the bases thereof to be securely mounted upon the machine table top 18. The bearing mounts 146 and 148 include linear bearings 152 therein which are held in place with bore seals 154. A screw 156 and a jam nut 158 are provided at an intermediate point along the bearing 152. Lower ends of the bearing mounts 146 and 148 are received within recesses journaled and the top surface of the table top 18 to provide additional support therefore.

The support shafts 132 and 134 are secured to a height adjustment crossbar 160 having openings therethrough for receiving the support bars and traversing the distance therebetween. Bolts 162 are utilized to securely mount the crossbar 160 about the support shafts 132 and 134. The crossbar 160 includes a hole 164 therethrough which aligns with holes 166, 168 and 170 through the table top 18, C-shaped bracket 136 and mounting plate 46, respectively. The holes 164–170 receive a crank shaft 172 therethrough. Crank shaft 172 includes upper and lower sections 174 and 176 which are threadably mounted to one another such that as the sections 174 and 176 rotate relative to one another, they extend and contract along the rotational axis. Optionally, the crank shaft 172 may be a one piece shaft with two threaded ends. The upper section 174 is securely mounted within a tubular lead screw nut 178 extending through the opening 168 within the bracket 136. The lead screw nut 178 is bolted to the lower surface of the bracket 136. The lower section 176 extends through the openings 164 and 166 to receive a crank handle 180 on its lower end. The lower section 176 is rotatably supported within a bearing mount 182 securely affixed to the bottom side of the height adjusting crossbar 160. A spring pin 184 secures the crank handle 180 to a drive shaft extending from the lower end of the lower section 176.

The crank shaft 172 enables the operator to adjust the operating height of the gun assembly. To effect this adjustment, the user first loosens the bolts 142 to enable the collar 138, bracket 136 and mounting plate 46 to be axially moved along the support shafts 132 and 134. Thereafter, the operator rotates the crank handle 180 to induce linear movement between the upper and lower sections 174 and 176 of the crank shaft 172. By way of example, when the crank shaft 172 is rotated in the clockwise direction, the upper section 174 may slide toward the lower section 176. Divergently, when the crank shaft 172 is rotated in the opposite direction, the upper section 174 moves upward away from the lower section 176, thereby raising the operating height of gun assembly. As the upper and lower sections 174 and 176 move relative to one another along the crank shaft's rotational axis, the distance between the crossbar 160 and the mounting plate changes. Once the gun assembly is set at a new operating height, the bolts 42 are tightened to securely affix the bracket 136 to the support shafts 132 and 134. Once the collars 138 and 140 are resecured to the supporting shafts 132 and 134, the gun assembly may be moved from a position within the container and a position remote therefrom when the support shafts 132 and 134 are linearly driven upward and downward. In this manner, the crank shaft 172 adjusts the operating position of the gun assembly, while maintaining the same amount of travel by the gun assembly between the glue applying position and the gun assembly's remote position, at which containers are switched.

Figure 5:
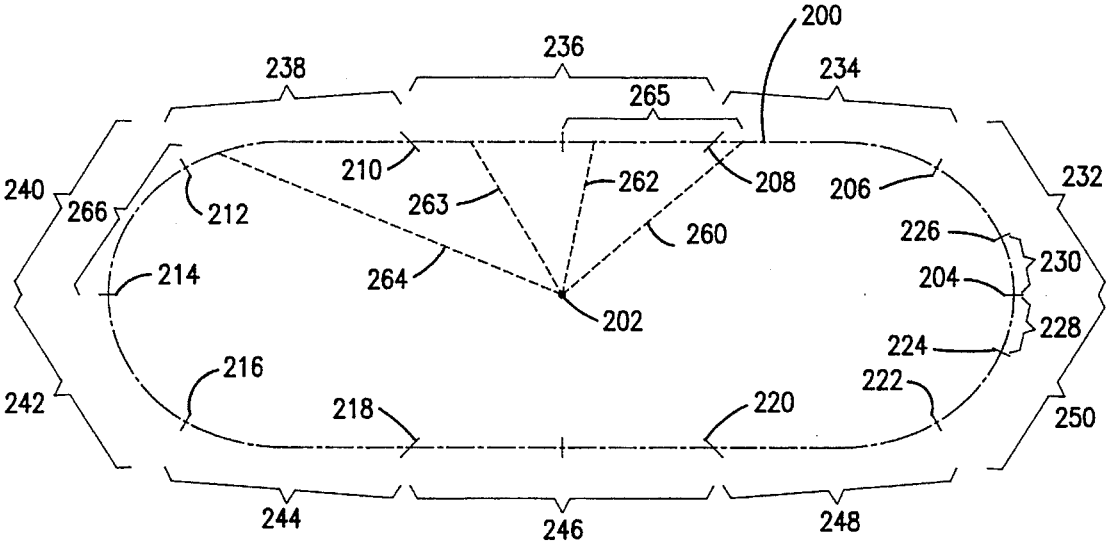
FIG. 5 illustrates a top plan diagram of the processing flow of the glue gun.

Hereafter, the operation of the motor 12 will be described in connection with FIG. 5. FIG. 5 illustrates an exemplary inner contour of a container, generally designated by the reference numeral 200, which represents the path along which the glue is applied to the container. By way of example only, the glue is applied in a counterclockwise direction. The center point 202 represents the rotational axis (directed into the page) about which the injection gun 74 rotates while spraying the glue. The motor 12 may be a stepper motor and the like which is controlled by control means 13 to rotate over 360°. By way of example only, a 360° revolution of the motor is separated into one thousand separate step units. Hence, the motor must move approximately three step units to rotate one degree. Within the control means 13 which may comprise a program controlling the motor, the 360° path (or 1000 step units) is dissected into a plurality of segments, each of which corresponds to a different motor speed.

By way of example, the container is dissected into ten contiguous segments 232–250 separated by lines 204–222. The motor changes speeds each time it crosses one of lines 204–222 into a new segment. The points 204–226 are defined by a corresponding number of stepper units from a zero reference point 224 set within the program. The motor changes speeds each time it rotates a set number of stepper units corresponding to the lines 204–222. By way of example, the motor is controlled to rotate approximately 380° during each glue applying operation, including approximately a 10° acceleration region 228, a 360° glue applying region and a 10° over travel region 230. The point 204 corresponds to the glue starting and stopping point. A motor starting point 224 may be set as the zero step unit position with the glue starting point 204 located approximately 30 step units (10°) beyond the motor starting point 224. Similarly, a motor ending point 226 may be set 30 step units beyond the glue ending point 204.

The motor starting point 224 is set before the glue starting point 204 to afford an acceleration time to allow the motor 12 and injection gun 74 to reach a desired rotational velocity before the glue is injected. This ensures that the leading portion of the bead of glue is evenly distributed upon the container. The injection gun 74 changes rotational velocities between each segment 232–250 in order to apply an even bead of glue clockwise about the container. Once the injection gun 74 completes a glue application pass about the container, the glue is turned off at the glue ending point 204 and the gun continues to rotate to the motor ending point 226 approximately 10° beyond the glue ending point 204 in order to spread out the trailing end of the glue stream.

The following Table 1 sets forth an exemplary processing sequence followed by the stepper motor to effect a glue application pass.

TABLE 1

| |
|---|
| Move Gun to Starting Point 224 and Reset Parameters |
| Set 1st Speed and 1st Destination and Begin Rotation |
| Turn on Nozzle When Reaches 1st Destination |
| Set 2nd Speed and 2nd Destination and Continue Rotation |
| Set 3rd Speed and 3rd Destination and Continue Rotation |
| . |
| . |
| . |
| Set Nth Speed and Nth Destination and Continue Rotation |
| Turn Off Nozzle |
| Set N + 1 Destination |
| Stop Rotation |

As the injection gun 74 conducts a glue application pass, the distance between the nozzle 78 and the container wall at the point of glue application varies. Consequently, the rotary velocity similarly varies with which the glue is applied to the container wall.

To adjust for these changes in rotary velocity, the rotary speed of the gun 74 is changed between each segment 232–250, such that the rotary speed of the injection gun 74 increases as the radial distance between the container and the nozzle decreases. Similarly, the rotary speed of the injection gun 74 decreases as the radial distance between the container and the nozzle increases. For instance, the rotary velocity of the injection gun 74 is less during segment 232 than it is during segment 234, since the radial distance between the center point 202 and the container wall throughout the segment 232 is greater than the radial distance between the center point 202 and the container wall throughout the segment 234. Similarly, the injection gun 74 rotary velocity is less throughout segment 234 than throughout segment 236. Once the injection gun reaches point 210, the rotary velocity is decreased for segment 238 as compared to the rotary velocity during segment 236. Similarly, the rotary velocity is again decreased during segment 240 as compared to that during segment 238.

Additionally, the rotary velocity of the injection gun 74 is adjusted to compensate for changes in the angular relation between the container side wall and the projection axis along which the glue stream is sprayed. Dashed lines, generally designated by the reference numerals 260–264, represent exemplary projection axes along which glue is sprayed from the nozzle 78 onto the container wall, In the present example, the portion of segment 234 to the right of the axis 260 represents a "downstream" portion of the wall, while segment 236 represents an "upstream" wall portion relative to the axis 260. As the injection gun 74 rotates in a counterclockwise direction, the angle changes between the projection axis 260 and a plane extending through the receiving or upstream portion 265 of the container wall, upon which the glue bead is to be applied. As the nozzle 78 moves from the projection axis 260 toward the projection axis 262, a glue lagging effect is experienced whereby the build up of glue to form a glue bead lags behind the point at which the projection axis of the glue stream intersects the container wall. This lagging effect is attributed partially to the fact that the path of the glue stream (i.e., projection axis) forms an acute angle with a plane aligned tangent to the wall and extending upstream from the glue stream intersecting point. In this manner, the glue is somewhat sprayed away from the upstream or direction of rotation of the injection gun back onto the previously applied downstream bead of glue. Divergently, within segment 238, the projection axis 264 of the glue stream forms an obtuse angle with a plane tangent to, and extending through, the upstream portion 266 of the container. This obtuse angular relation between the projection axis 264 of the glue stream and the container creates a "leading effect", whereby the glue stream is pushed upstream along the container side wall in the same direction in which the injection gun 74 is traveling away from the previously applied bead of glue. This leading effect creates a bead of glue proximate or slightly upstream of the projection axis 264 of the glue stream.

To compensate for these differences in the physical response and buildup of the glue bead caused by the leading and lagging effects, the injection gun's rotational velocity is varied between isometric segments, namely segments located on the same side of a diameter of the container and being located equal radial distances from the center 202, such as segments 234 and 238. By way of example, the rotational velocity of the injection gun 74 is faster when traveling through segment 238 than the rotary velocity when traveling through segment 234. By utilizing a slower rotary velocity during segment 234, the injection gun 74 allows the lagging bead of glue to "keep up" with the glue stream. Similarly, by increasing the rotary velocity during segment 238, the injection gun ensures that the leading glue bead does not build up in front of the glue stream. By maintaining a desired relation between the glue stream and the glue bead, overly thin beads and undue glue build up (and thus dripping) are prevented. The rotational velocity within each segment between points 204 and 214 decreases from the fastest to the slowest segments in the following manner, segment 236, 238, 234, 240, and 232.

It is to be understood that segments 242–250 represent a mirror image of segments 232–240 and thus the stepper motor is controlled in an identical manner. The motor rotates at the same velocity during diametrically opposed segments. In particular, the rotary velocity is equal within segments 232 and 242, segments 234 and 244, segments 236 and 246, segments 238 and 248, and segments 240 and 250.

Initially, the injection gun 74 is rotated to the motor starting point 224 and all parameters are reset (see Table 1). Thereafter, the speed and destination variables controlling the stepper motor are set to a first speed and a first destination (in step units). The first speed corresponds to the rotary velocity at which the injection gun 74 travels through the acceleration segment 228 between the motor starting point 224 and the initial glue applying point 204. Once the motor rotates to the first destination (identified by the number of step units spanning the acceleration segment 228) (e.g., 30), the glue spray nozzle 78 is turned ON. Thereafter, the injunction gun 74 continues to rotate, however, the motor speed and destination are reset to a second speed and a second destination. The second speed corresponds to the rotary velocity at which the injection gun 74 travels through the segment 232. The second destination identifies the number of stepper units from the starting point 224 to the point 206 (e.g., 104). Optionally, the velocity of the motor between point 224 and point 206 remains unchanged (i.e. the first and second speeds equal one another). Thereafter, the stepper motor rotates by a distance necessary to move the injection gun 74 from point 204 to point 206 while the nozzle 76 continues to emit glue at the pressure delivered from the pipe 124. After reaching point 206, the stepper motor's speed and destination parameters are reset to a third speed and a third destination corresponding to segment 234 and to point 208. Once the injection gun 74 reaches point 208, the speed and destination parameters for the stepper motor are reset to correspond for segment 236 and to point 212. This process is repeated the necessary number of times until the injection gun 74 travels completely about the container and passes through segment 250. Once the injection gun 74 reaches the ending point 204, the motor continues to rotate but the glue spray nozzle is turned OFF. At point 204, the destination is reset to point 226 (i.e. $N+1^{th}$ destination). The injection gun 74 travels to the ending point 226 after the glue is turned OFF at point 204 to carry the nozzle through the over travel region 230 and spread out the final portion of the glue sprayed from the spray nozzle 76. The inclusion of acceleration and over travel regions 228 and 230, respectively, prevent build up of glue at any one point upon the container beyond the desired bead size, thereby preventing the glue from dripping and running.

During operation, the support assembly 10 is driven upward along the gun rotational axis (e.g., vertically upward in the preferred embodiment), thereby moving the gun assembly 2 and drive assembly upward to a loading position. While in the loading position, the lower end of the nozzle 76 is above the upper edge of the container to allow the container to be placed under the injection gun 74. Once the container is properly aligned, such that the rotational axis of the injection gun 74 is aligned with the longitudinal axis of the container, the support assembly 10 is lowered. The injection gun is lowered to a desired depth at which the nozzle 76 is aligned proximate the glue receiving region of the edge of the container. The nozzle 76 may be within or above the container depending upon the outward trajectory of the nozzle 78. Once properly aligned, the drive motor 12 is energized to rotate the extension shaft 30 and spline shaft 42, consistent with the steps of Table 1, thereby driving the pulley 68 via the timing pulley 64 and belt 66. As the driven pulley 68 rotates, it similarly forces the gun rotating mount 92 and the inner race 94 to rotate within the bearing housing 100. The rotating mount 92 causes similar rotation of the module mounting plate 86, base block 90 and support frame 88 which causes the injection gun 74 to rotate about its rotational axis. The foregoing elements are rotationally positively locked to one another to maintain a predefined angular relation between the injection gun 74 and motor 12.

Consistent with Table 1, the motor 12 initially orients the injection gun 74 such that the opening 78 within the nozzle 76 is directed toward the motor starting point 224. Thereafter, the motor begins rotation to bring the injection gun 74 up to a desired rotational velocity. The injection gun 74 reaches the desired rotational velocity within the acceleration region 228. Once the injection gun 74 crosses the glue starting point 204, pressurized air is induced within the air line 148 and along the air channel in order to open the pneumatic valve 83, thereby spraying the pressurized glue from the opening 78 within the nozzle 76. As the hot melt injection glue passes through the pipe 84, the sensor 112 detects its temperature and accordingly turns the heater 114 ON and OFF to maintain the glue at a desired temperature.

It is desirable to bring the nozzle 76 to a preset initial rotating speed before spraying glue therefrom to prevent dripping. Generally, this start up process only requires a portion of one rotation of the nozzle (such as 10° or less). As the nozzle 76 rotates beyond the glue starting point 204 to spray glue onto the container, the nozzle's rotational speed is varied as shown in Table 1 between adjacent segments 232–250 to compensate for variation in the distance between the nozzle 76 and the container's side wall. While this distance continuously changes as the glue stream passes along a curved surface, segments of the container wall are spaced radial distances from the nozzle 76 which do not vary substantially within a given segment. Hence, to reduce the program steps needed to change the motor speed between segments, the region within each segment is treated commonly based on an average radial distance therein. Once the injection gun completes a revolution and reaches the glue ending point 204, the air pressure within the air line 148 is reversed to close the pneumatic valve 83, thereby turning the glue stream OFF. As explained above, the injection gun 74 continues to rotate past the glue ending point 204 in order to spread out the trailing end of glue stream along the over travel region 230 up to the motor stopping point 226.

Once the injection gun 74 completes a revolution, it is halted and the support assembly 10 is again activated to lift the mounting plate 46 and thus the gun assembly 2 upward away from the container open end. The container is then removed from the glue application station and passed to a fitment applying station as is known in conventional systems at which a fitment is inserted. The fitment contains no glue about its perimeter. As the fitment is inserted into the container, it smears the glue bead along the adhesion region to effect 100% adhesion and approximately 100% fiber tear. The foregoing process is repeated for each container.

Figure 6:
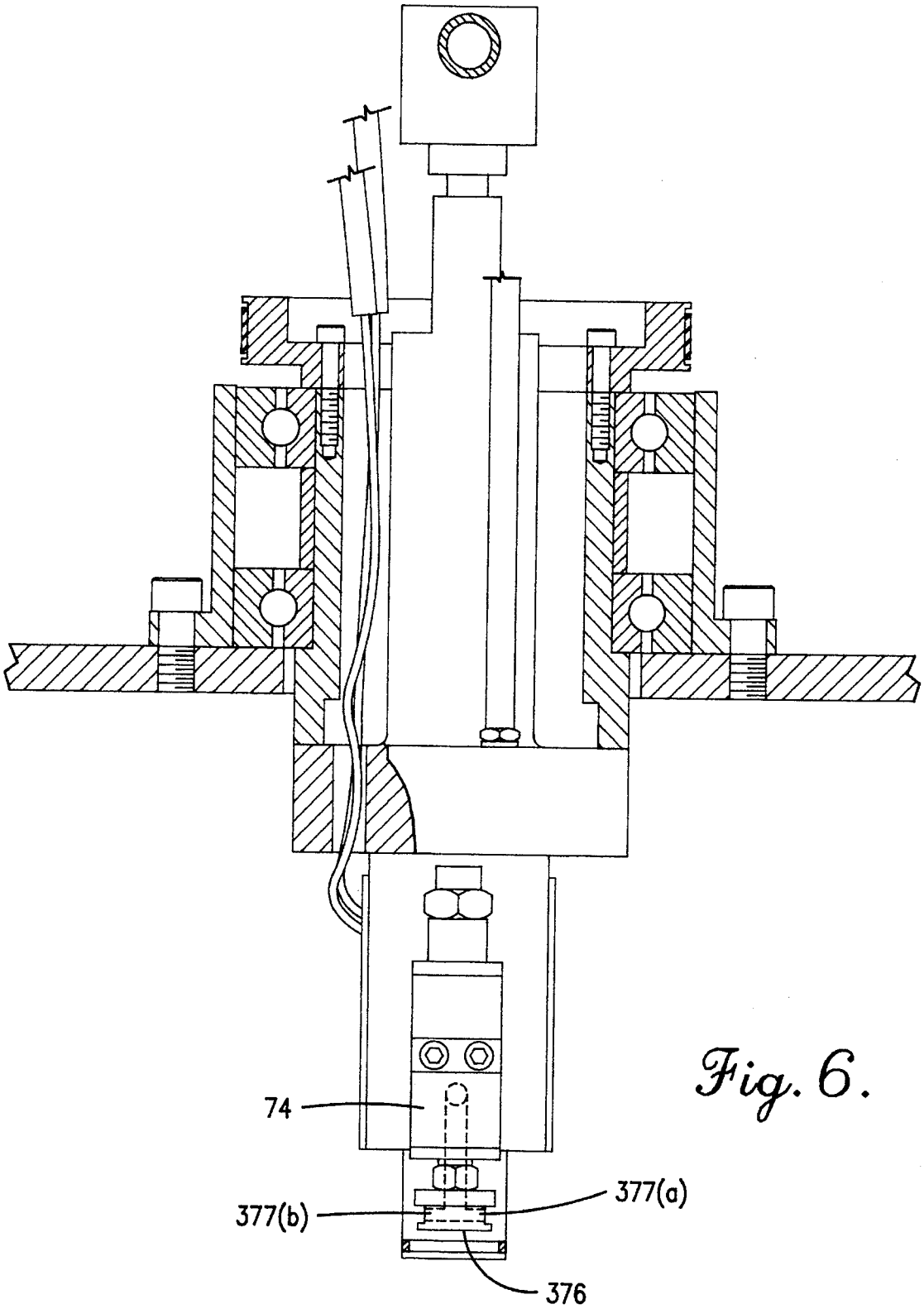
FIG. 6 illustrates a front view of an alternative embodiment of the glue gun of FIG. 4, wherein the gun includes a nozzle having two openings directed 180° apart.

Optionally, the stepper motor 12 will be controlled to afford different speeds and a different number of segments, depending upon the geometry of the container, the position of the nozzle, and the temperature and pressure within the glue. For instance, an oval container as illustrated in the preferred embodiment may utilize 10 segments, while a rectangular container having oval shaped corners may utilize 12 or more segments. Similarly, the rotational velocities within each segment of a rectangular container will differ from those utilized in an oval container since the average radial distance within each segment will vary. As a further option, the nozzle may be modified as shown in FIG. 6 to include two openings directed 180° apart. In such a configuration, the injection gun 74 includes modified nozzle 376 having two openings 377*i* & *b* directed 180° apart for dispensing the glue and would only be rotated half the distance of that utilized in the preferred embodiment. In such an alternative, the openings directed in opposite directions would inject hot glue upon opposite sides of the container simultaneously thus allowing the injection gun to only be rotated half the distance. The gun would hence use diametrically opposed acceleration and over travel regions. As further options, the means for driving the vertical support assembly may utilize air cylinders, a cam mechanism, an oscillating mechanism and the like.

It is to be understood that the inventive apparatus may be aligned within any plane, such as a horizontal plane, a vertical plane, and the like. While the inventive apparatus is illustrated in the preferred embodiment as being aligned in an upright position, this alignment is not necessary. Instead, the assembly may be inverted, with the open end of the container being about its bottom end and wherein the gun assembly 2 is raised into the bottom of the container to inject hot melt glue. Further, the instant invention may be utilized to apply glue to any desired glue receiving region within a container, such as along either end of the container or along any region therebetween. Moreover, multiple nozzles may be aligned end-to-end along the rotational axis of the gun assembly to apply more than one bead of glue to said container simultaneously and adjacent one another.

Further, the opening 78 in the nozzle 76 may be directed at a non-right angle to the rotational axis, to direct glue onto the adhesion region within the container while maintaining the nozzle 76 remote from and outside the container. In this arrangement, as the nozzle rotates it directs glue downward into the container, and hence would not need be moved linearly along the rotational axis between glue applying operations to allow containers to be loaded and unloaded. Instead, the glue gun would remain linearly stationary while containers intermittently passed therebelow.

The foregoing system may equally be applied to round containers.

From the foregoing it will be seen that this invention is one well adapted to attain all the ends and objects hereinabove set forth, together with the other advantages which are obvious and which are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the accompanying drawings is to be interpreted as illustrative and not in a limiting sense.

Having thus described the invention, what is claimed is:

1. An apparatus for applying a bead of glue to an interior of a container along a glue path, said container having walls formed about a central longitudinal axis extending between opposite ends of the container, said container including at least one open end, wherein the apparatus comprises:

a gun assembly for applying at least one glue bead to a glue receiving region about an interior surface of said walls, said gun assembly being located along, and rotated about, said longitudinal axis of said container while spraying said glue outward therefrom along at least one glue trajectory in order to apply said at least one glue bead; and drive means operably connected to said gun assembly for rotating said gun assembly about said longitudinal axis, said drive means connected to drive control means, said drive control means varying a rotational velocity of said gun assembly while applying said glue bead about said glue path based upon variations in a radial distance between said gun assembly and a point at which said glue contacts said interior surface of said container to compensate for variations in said radial distance and provide a generally uniform glue bead.

2. An apparatus according to claim 1, further comprising:

a support assembly upon which said gun assembly is mounted for moving said gun assembly along said longitudinal axis of said container between a position remote from said glue receiving region and a position proximate thereto.

3. An apparatus according to claim 1, wherein said drive means is operably connected to said gun assembly by a pulley means to maintain a positive rotatory relation therebetween, said pulley means being linearly displaceable relative to one of said gun assembly and said drive means to provide linear movement between said gun assembly and said drive means in a direction parallel to said central longitudinal axis.

4. An apparatus according to claim 1, further comprising adjustment means upon which the gun assembly is mounted for adjusting a stationary position of said gun assembly along said longitudinal axis when positioned remote from the container based upon a height of the walls to allow for use with containers of different sizes.

5. An apparatus according to claim 1, wherein said drive means is operably controlled to vary the rotational velocity of the gun assembly while applying said glue bead such that the rotational velocity is constant within a discrete segment of the glue path and wherein the rotational velocity within said discrete segment of the glue path varies from the rotational velocity within an adjacent discrete segment of the glue path.

6. An apparatus according to claim 1, wherein said gun assembly emits at least two streams of glue, symmetrically arranged about said longitudinal axis, said gun assembly rotating a partial revolution about said longitudinal axis at least spanning a distance between adjacent streams of glue.

7. An apparatus according to claim 1, wherein said gun assembly is operably connected to said drive means such that rotation of the gun assembly may be initiated from a motor starting point located an acceleration distance before a glue starting point at which spraying of said glue is initiated.

8. An apparatus according to claim 1, wherein said gun assembly additionally comprises a glue spray control means for initiating and terminating said spraying action at a common point within a revolution thereof and, wherein said drive means is operably connected to said gun assembly such that after terminating said glue spraying the gun assembly continues to rotate past said common point by an over travel distance before stopping rotation to spread out a trailing end of said glue bead.

9. An apparatus according to claim 1, said gun assembly further comprising:

a rotating mount aligned along, and rotational about, said longitudinal axis and having one end rotatably engaging said drive means;

an injection gun mounted upon an opposite end of said rotating mount and projecting along said longitudinal axis; and a nozzle mounted on an outer end of said injection gun for directing glue therefrom at an angle of at least 45° with respect to said longitudinal axis.

10. An apparatus according to claim 1, said drive means further comprising:

a motor with a drive shaft for rotating said gun assembly;

first and second pulleys connected to one another and rotatably mounted to said drive shaft and said gun assembly, respectively, at least one of said first and second pulleys being slidably mounted to a corresponding one of said drive shaft and said gun assembly to afford movement between said gun assembly and said motor along said longitudinal axis while maintaining a driving connection therebetween.

11. An apparatus according to claim 1, further comprising belt and pulley means for rotatably connecting said drive means and said gun assembly and for allowing linear movement therebetween in a direction parallel to said longitudinal axis.

12. An apparatus according to claim 1, wherein said drive means is operably controlled to vary a rotational velocity of said gun assembly between a faster velocity, when a projection axis of said sprayed glue forms an obtuse angle with a plane aligned tangent to and extending upstream of an upstream portion of said wall to receive glue, and a slower speed when said projection axis forms an acute angle with said plane.

13. An apparatus for applying a bead of glue to an interior of a non-cylindrical container along a glue path, said container having walls formed about a central longitudinal axis extending between opposite ends of the container, said container including at least one open end, wherein the apparatus comprises:

a rotating mount aligned along, and rotational about, said longitudinal axis;

an injection gun mounted upon said rotating mount and projecting along said longitudinal axis, said injection gun including a spraying means for applying at least one glue bead to a glue receiving region about an interior surface of said container walls;

a support assembly upon which said rotating mount is supported for moving said rotating mount and injection gun along said longitudinal axis of said container between a position remote from said glue receiving region and a position proximate thereto;

an adjustment means upon which said support assembly is mounted for adjusting a stationary position of said rotating mount and injection gun along said longitudinal axis when positioned remote from the container based upon a height of the walls to allow for use with containers of different sizes;

drive means operably connected to said rotating mount for rotating said rotating mount and injection gun about said longitudinal axis; and drive control means for operably controlling said drive means to vary the rotational velocity of said rotating mount and injection gun while applying said at least one glue bead about said glue path based upon variations in a radial distance between said injection gun and a point at which said glue contacts an interior surface of said container walls to compensate for variations in said radial distance.

14. An apparatus according to claim 13, wherein said rotating mount is operably connected to said drive means such that rotation of the injection gun may be initiated from a motor starting point located an acceleration distance before a glue starting point at which spraying of said glue is initiated.

15. An apparatus according to claim 14, wherein said spraying means additionally comprises a glue spray control for turning the spraying means on and off.

16. An apparatus according to claims 15, wherein said drive means is operably connected to said rotating mount such that the glue spray control means may turn the spraying means off at a common point within a revolution of the rotating mount and, after turning said glue spraying means off, the rotating mount continues to rotate past said common point by an over travel distance before stopping rotation to spread out a trailing end of said glue bead.

* * * * *